US008871342B2

(12) United States Patent
Dufour et al.

(10) Patent No.: US 8,871,342 B2
(45) Date of Patent: Oct. 28, 2014

(54) CELLULOSE FIBRE-BASED SUPPORT CONTAINING A MODIFIED PVA LAYER-METHOD FOR PRODUCTION AND USE

(75) Inventors: Menno Dufour, Lyons (FR); Diego Fantini, Pont-Eveque (FR); Gilles Gauthier, Salaise sur Sanne (FR)

(73) Assignee: Ahlstrom Corporation, Helsinki (FI)

( * ) Notice: Subject to any disclaimer, the term of this patent is extended or adjusted under 35 U.S.C. 154(b) by 113 days.

(21) Appl. No.: 13/060,223

(22) PCT Filed: Jan. 19, 2011

(86) PCT No.: PCT/FI2011/050039

§ 371 (c)(1), (2), (4) Date: Sep. 13, 2012

(87) PCT Pub. No.: WO2011/104427

PCT Pub. Date: Sep. 1, 2011

(65) Prior Publication Data

US 2013/0040134 A1 Feb. 14, 2013

(30) Foreign Application Priority Data

Feb. 23, 2010 (FR) ..... 10 51283

(51) Int. Cl.

| | |
|---|---|
| ***B32B 27/00*** | (2006.01) |
| ***B32B 27/10*** | (2006.01) |
| ***B05D 3/12*** | (2006.01) |
| ***D21H 27/00*** | (2006.01) |
| ***D21H 21/16*** | (2006.01) |
| ***D21H 19/20*** | (2006.01) |
| ***D21H 27/06*** | (2006.01) |
| ***D21H 19/32*** | (2006.01) |

(52) U.S. Cl.

CPC ..... *D21H 19/32* (2013.01); *D21H 27/00* (2013.01); *D21H 21/16* (2013.01); *D21H 19/20* (2013.01); *D21H 27/001* (2013.01); *D21H 27/06* (2013.01)

USPC ..... 428/340; 428/342; 428/358; 428/511; 427/358; 427/361

(58) Field of Classification Search

None

See application file for complete search history.

(56) References Cited

U.S. PATENT DOCUMENTS

| | | | |
|---|---|---|---|
| 3,162,543 | A | 12/1964 | Wilkins |
| 6,379,499 | B1 | 4/2002 | Yang et al. |

FOREIGN PATENT DOCUMENTS

| | | |
|---|---|---|
| WO | 2004/101887 | 11/2004 |
| WO | 2005/071161 | 8/2005 |
| WO | WO2009/147283 A1 | 12/2009 |

OTHER PUBLICATIONS

International Search Report for PCT/FI2011/050039, mailed Jun. 8, 2010.

Written Opinion of the International Searching Authority for PCT/FI2011/050039, mailed Jun. 8, 2010.

*Primary Examiner* — Sheeba Ahmed

(74) *Attorney, Agent, or Firm* — Nixon & Vanderhye P.C.

(57) ABSTRACT

A cellulose fiber-based support of which at least one surface is coated with a layer containing at least one water-soluble polymer having hydroxyl functions, at least some of which have been reacted beforehand with at least one organic molecule that contains at least one vinylic function, characterized in that said organic molecule also has an aldehyde function. Method for production thereof.

15 Claims, 4 Drawing Sheets

CELLULOSE FIBRE-BASED SUPPORT CONTAINING A MODIFIED PVA LAYER-METHOD FOR PRODUCTION AND USE

This application is the U.S. national phase of International Application No. PCT/FI2011/050039, filed 19 Jan. 2011, which designated the U.S. and claims priority to French Application No. 1051283, filed 23 Feb. 2010, the entire contents of each of which are hereby incorporated by reference.

FIELD OF THE INVENTION

The invention relates to a novel support based on cellulose fibres and to the production method therefor. It further relates to the use of the support for siliconizing.

The area of application of the present invention relates to supports that are intended for siliconizing for all self-adhesive products, such as pressure sensitive labels or adhesive tape, for the envelope industry, weight/price equipment, feminine hygiene products or graphic applications, for vegetable parchment and greaseproof paper representing a non-limiting selection of applications.

SURVEY OF THE RELATED ART

Supports that are to be siliconized must possess certain properties which are defined in advance according to the final application for which they are intended. Thus, once they have been siliconized, such support must guarantee two primary functions: they must protect the self-adhesive products before they are used and they must be capable of a perfect adhesive transfer upon removal.

These supports generally consist of a cellulose base substrate coated with a layer of a water-soluble binding agents and latexes, and pigments. They may be produced by coating, size-press or metering-size-press methods. These various deposition methods are all familiar to one skilled in the art and are followed by a calendering or supercalendering step.

The chief properties required when manufacturing such cellulose fibre-based supports include mechanical strength, silicone anchorage, silicone hold-out and transparency.

Depending on the market that is being targeted in particular, more or less emphasis may be placed on transparency of the support. For example, the weight/price market requires supports that are more transparent than the market for envelopes.

The silicone hold-out must provide good surface coverage and afford uniform protection. This objective is generally achieved with a quantity of silicone in the order of 1 to 2 g/m$^2$. However, it is important to be able to limit the quantity of silicone required without loss of its coverage capabilities so as to avoid possible risks of additional costs.

The cost and the reactivity of the silicones require that the support, on which they are applied, fulfils a certain number of criteria.

First of all, the chemical structure of the support must not prevent the silicone system from cross-linking, i.e. the polyaddition reaction between the vinylic functional groups of the silicone resin and the hydrogen siloxane functional groups of the cross-linking agent. Next, it is necessary that the support provides a perfect anchorage of the silicone to the surface thereof. Furthermore, considering the high cost of silicone, it is important that the amount of silicone deposited on the support is as small as possible. To do this, the support has to form a barrier and thus limit as much as possible the penetration of the silicone inside the support. Likewise, the surface of the support has to be as regular as possible so as to allow a homogenous application of the silicone.

In other words, the first problem set is how to develop a support that allows simultaneously an efficient anchorage and an optimal cross-linking of the silicone while still reducing as much as possible the penetration of the said silicone inside the support itself.

The siliconizing step thus depends on the support, but also on the silicone and the cross-linking agent used. The siliconizing methods are defined according to the silicone cross-linking mode, and these are divided into two categories, the first being silicones that are cross-linked under UV radiation or electron beams, and the second being "thermal cross-linking" silicones. Since the first category is less exploitable from both the technical and financial points of view, thermally cross-linked silicones account for the larger market.

Silicones are cross-linked thermally by passing the support, coated in silicone beforehand, through a kiln. The kiln temperature must be such that the surface of the support reaches the temperature at which silicone cross-linking takes place. In order to enable cross-linking at a lower temperature, silicones have been developed, and are called "LTC silicones" (low temperature curing). Now, new silicone systems are on the market: fast curing system with lower catalyst content (i.e.: Platinum). People in the self-adhesive business are using the term of "curing" while speaking about the cross-linking reaction of silicone. The range of temperatures at which cross-linking occurs with LTC silicones is from 60 to 100° C. rather than 110 to 150° C. for conventional silicones. However, the main disadvantage of using LTC silicones is that the cross-linked silicone presented a very low anchorage on the support.

There are essentially four types of support that lend themselves to siliconizing, these being "coated" papers, vegetable parchment, glassine and greaseproof paper.

"Coated" papers, so called CCK (Clay Coated Kraft), are obtained by depositing at least one coated layer of a mixture containing pigments (clay, calcium carbonate for example) and binders (starch, polyvinyl alcohol, latex) on a cellulose fibre-based support. To obtain a satisfactory silicone hold-out, the coated layer is typically created in a quantity of 5 to 12 g/m$^2$. The support is then calendered. In general, coated papers are designed particularly for applications with envelopes, office labels, hygiene, and graphic applications . . . .

Vegetable parchment paper is a paper made by passing a waterleaf sheet (completely unsized sheet of paper, and having low water resistance), made from chemical wood pulp through a bath of sulfuric acid, or (at times) zinc chloride, under established conditions of time, temperature, and the like. The treated paper is then washed thoroughly so as to remove the acid or zinc salt, after which it is dried. The chemical partially dissolves or gelatinizes the paper, which is then regenerated when the chemical is diluted by the washing. This forms a very tough, stiff paper with an appearance somewhat like that of a genuine parchment. Because paper treated in this manner has a tendency to become brittle and to wrinkle upon drying, it is frequently treated with a plasticizing agent, usually glycerine or glucose.

Such vegetable parchment can be then coated with silicone (generally water based silicone system), either on one side, or on both side. Silicone coating can occur either on the parchmentizing line, or on an off-line coater, to produce release vegetable parchment. Such release paper has a variety of applications in packing, storage and restoration, in composites industry, in dry mounting presses, and as slip sheets for printing. It will withstand heat. Nothing will stick to it.

Glassine is a more refined support than clay coated paper. The process by which it is manufactured differs also in the method used to form the coating. In fact, the film is formed in a size-press or metering size-press coating process and in the final step calendering is replaced by supercalendering. As a result, the product obtained is denser. It also has greater mechanical resistance and transparency than clay coated paper. Glassine is less dimensionally stable than clay coated paper. The mixture used to coat the cellulose support is composed of water-soluble binders having a film-forming nature (such as starch, polyvinyl alcohol (PVA) and carboxymethyl cellulose (CMC)), and often of a viscosifying agent (CMC). The weight of the coating is in the order of 1 to 2 $g/m^2$ on each surface.

Greaseproof paper is similar to glassine in term of machine process, except that the silicone layer may be applied on paper machine using water based emulsion of silicone. Final applications are packing, storage and restoration.

The technical problems encountered in the known art are chiefly associated with the transparency of the support, anchorage of the silicone on the support, and the cross-linking of silicone. The quantities of silicone and catalyst (i.e.: Platinum) used in the siliconizing step must also be limited because of the high cost of these substances.

In the past, any changes to the siliconizing method, in particular either by reducing the quantity of the catalyst (i.e.: Platinum) used or by using LTC silicones, have resulted in difficulties with regarding the anchorage of silicone.

Document WO2005/071161 describes a glassine that is coated with a compound consisting mostly of PVA. This cellulose-based support is then functionalized by grafting onto it an organic molecule containing a vinylic function and an acid halide function. The hydroxyl functionalities of the substrate react with the acid halide function of the organic molecule to create covalent bonds between them. The chain-terminal vinylic function enables good anchorage and excellent cross-linking of the silicone due to the formation of covalent bonds between the support and the silicone. This siliconizing step of this glassine may also be performed with LTC silicones. The results obtained demonstrate an improvement of the anchorage of silicone on the support.

Grafting reaction presented in the previous paragraph could be performed either in a solvent based process or by applying the pure reactant on the substrate. It can not be done in a water based process due to the fact that this type of organic molecules are very sensitive to water as the acid halide function reacts with water and forms a functionality that will not react anymore with the substrate. So, such a type of molecules can not be used in conventional surface paper treatments that are mostly water based. Another drawback is the production of hydrochloric acid as a by-product which renders it unattractive for industrial applications.

Using a solvent based process could be envisaged but is facing huge problems in term of safety and environmental issues.

Up to now, the technology to apply very low amount of such pure organic molecules on a paper machine is not set yet.

In other words, the problems that the present invention is intended to solve are an improved support that does suffer less from at least one or more of the drawbacks described in the preceding.

The present invention suggests functionalizing with vinylic functionalities a water soluble polymer that contains hydroxyl functionalities. This functionalization can be done in a water based process before it is deposited on the cellulose support. In the present invention the organic molecule used present an aldehyde function, optionally in the form of a hemiacetal or acetal, and at least one vinylic functionalitiy. The linkage between the water soluble polymer and the organic molecule results in an acetalization reaction between two hydroxyl functions of the water soluble polymer and the aldehyde functionalitiy from the organic molecule. It is known from the prior art that the product of this reaction is an acetal.

The acetalization reaction between PVA and an aldehyde containing a vinylic function is disclosed in document JP 2007269673. The use of the product of a reaction between PVA and undecylenic aldehyde is described for applications in the field of oral and dental hygiene.

The water soluble polymer functionalized with the method reported in this invention can be then coated onto a support based on cellulosic fibres, using any kind of surface treatment in the paper industry.

As soon as the functionalized water soluble polymer is applied on the paper, vinylic functions are present on the paper surface. The presence of the vinylic function enables the silicone to react with the substrate in the siliconizing stage generating covalent bounds between the silicone layer and the substrate.

The present invention provides to the substrate to be siliconized an improved silicone anchorage and represents a significant contribution to the search for technical and industrial solutions.

BRIEF DESCRIPTION OF THE INVENTION

Accordingly, the present invention represents a new approach to improve cellulose fibre-based supports that are intended to be covered with a silicone film. The products obtained by various embodiments of the invention demonstrate one or more enhanced properties like improved cross-linking and silicone anchorage properties, while enabling a reduction in the quantities of catalyst (i.e.: Platinum) and silicone used in the siliconization step.

In general, the present invention consists in functionalizing a water soluble polymer containing hydroxyl functions, that can be done in a water based process, before the film is formed on the cellulose support, in contrast to the prior art which consisted in grafting an organic molecule onto the cellulose support that had been coated with a compound containing a water-soluble binder.

The term cellulose fibre-based support is understood to mean a support that contains cellulose fibres that have been more or less adapted in proportions ranging from 80 to 99% by weight for purposes of their desired characteristics (density, transparency, mechanical properties).

More precisely, one object of one advantageous embodiment of the invention is a cellulose fibre-based support of which at least one surface is coated with a layer that is designed to endow the surface with barrier properties, in which the coated layer contains a water-soluble polymer having hydroxyl functions, at least some of which have been reacted beforehand with at least one organic molecule that contains at least one vinylic function and one aldehyde function (optionally in the form of a hemiacetal or acetal). The linkage between the water soluble polymer and the organic molecule is made by an acetal or hemiacetal functionality.

In addition, the coated layer with the water-soluble polymer base may be constituted of at least one water-soluble polymer containing hydroxyl functions that have been functionalized beforehand and at least one water-soluble polymer containing hydroxyl functions that have not been functionalized. The functionalized and unfunctionalized hydroxyl functions may be contained in the same water-soluble polymer, or they may be contained in a mixture of a least two water-soluble polymers comprising different hydroxyl functions.

Further, the coated layer that contains the functionalized water-soluble polymer may also contain other water-soluble binders, conventional additives, pigments and latexes.

This water-soluble polymer containing hydroxyl functions is advantageously chosen from the group including PVA, starch, alginate, CMC, hydrolysed or partially hydrolysed copolymers of vinyl acetate, which may be obtained for example by hydrolysing ethylene-vinyl acetate (EVA) or vinyl chloride-vinyl acetate, N-vinyl pyrrolidone-vinyl acetate, and maleic anhydride-vinyl acetate copolymers. This water-soluble polymer containing hydroxyl functions is advantageously PVA, whose molecular weight is preferably between 1,000 and 1,000,000 a.m.u, advantageously between 50,000 and 150,000 a.m.u.

This organic molecule typically represents a molecule containing at least one element from the group of C, H, N, O, non-metals such as the halogens, Si, S, P, metals such as Na, Li, K, Mg, Pb, etc.

The organic molecule contains at least one vinylic function (—CH═$CH_2$ functionalitiy) and one aldehyde function (—CH═O functionalitiy) that enables the organic molecule to be grafted onto the water-soluble polymer containing hydroxyl functions by acetalization reaction. The acetalization reaction is catalysed by acid conditions it is very familiar to one skilled in the art.

Such functionalized water soluble polymer can be then coated onto a support based on cellulosic fibres using any kind of surface treatment from the paper industry.

Therefore, the paper produced by the described process presents at the web surface vinylic functionalities that enable a better anchorage of the silicone during the subsequent step of siliconizing.

Accordingly, the water-soluble polymer containing the hydroxyl functions is functionalized before the coated layer is formed on the cellulose support, thereby producing, in a single, rapid step, a cellulose support including a molecule whose chain length enables the barrier between the silicone and the cellulose to be controlled.

For the sake of simplicity, the water-soluble polymer containing hydroxyl functions will be referred to by the abbreviation "PH" in the following. The terms "functionalized PVA" and "functionalized PH" will be used to denote the products of the reaction between PVA and PH and the organic molecule described in the preceding.

The formula of the organic molecule selected to functionalize the water-soluble polymer containing hydroxyl functions is advantageously as follows: $CH_2$═CH—(R)—CH═O where R=linear, branched or cyclic carbon chain that may contain heteroatoms.

The cellulose fibre-based support according to the present invention is preferably characterized in that said organic molecule is undecylenic aldehyde, $CH_2$═CH—($C_8H_{16}$)—CH═O. This compound contains a linear chain of eleven carbon atoms, with an aldehyde function at one end and a vinylic function at the other end thereof.

In a preferred embodiment, said organic molecule constitutes between 0.1% and 5% by weight of the PH. More advantageously, the organic molecule constitutes 1% by weight of the PH. Control of the grafting rate thus enables the silicone anchorage to be controlled afterwards, and this is assisted by the presence of the vinylic function.

The functionalized PH preferably constitutes at least 10% by weight of the top layer applied on the cellulose fibre-based support, advantageously between 20 and 100%.

The cellulose layer that forms the support according to the invention is typically has a mass in the range between 30 and 160 g/m2, preferably between 55 and 140 g/m2, and most advantageously in the order of 58 g/m2. At least one surface of this support covered by the described mixture in a quantity of 0.2 to 20 g/m2, preferably 1 g/m2.

The support according to one embodiment of the present invention may be prepared by the following method:

- formation of the cellulose fibre-based foil; with or without a parchementizing process.
- functionalization of the PH by grafting at least one organic molecule having at least one vinylic function and one aldehyde function that are capable of forming covalent bonds with the hydroxyl functionalitiy of the PH.
- coating the cellulose support, by methods known to one skilled in the art, with at least the functionalized PH; this step will advantageously be carried out at a temperature between 20 and 80° C., preferably at 65° C.
- calendering or supercalendering of the support if required.

According to a preferred method, the functionalized PH is prepared in an aqueous phase, at a temperature between 20 and 100° C., preferably between 80 and 95° C.

Coating techniques known to one skilled in the art further include size-press, metering-size-press, foulard coating, rod coating, "Champion" bar coating, "Meyer" bar coating, air-knife coating, gravure coating, scraper blade coating, sliding blade coating, single- and multilayer curtain coating, reverse roll coating, spray coating, atomisation coating, liquid application system (LAS) coating, kiss coating, foam coating, and any surface coating application process.

Generally, a cellulose fibre-based support according to the invention will be treated in a siliconizing step for use in supports for self-adhesive labels, adhesive tapes and vegetable parchment for example. It will be siliconized by any of the methods known to one skilled in the art.

EXEMPLARY EMBODIMENTS OF THE INVENTION AND DETAILED DESCRIPTION OF THE INVENTION

BRIEF DESCRIPTION OF THE DRAWINGS

The invention and the advantages it offers will be explained in greater detail in the following description of exemplary embodiments and with reference to the following figures.

$$CH_2{=}CH{-}(R){-}CH{=}O \text{ or optionally } CH_2{=}CH{-}(R){-}CH(OR_1)_2$$

where R=linear, branched and/or cyclic carbon chain that may contain heteroatoms, and $R_1$ independently is a hydrogen atom or an optionally branched, saturated or unsaturated, optionally substituted alkyl radical having from 1 to 12 carbon atoms optionally interrupted by N, O, or S heteroatoms.

Figure 1:
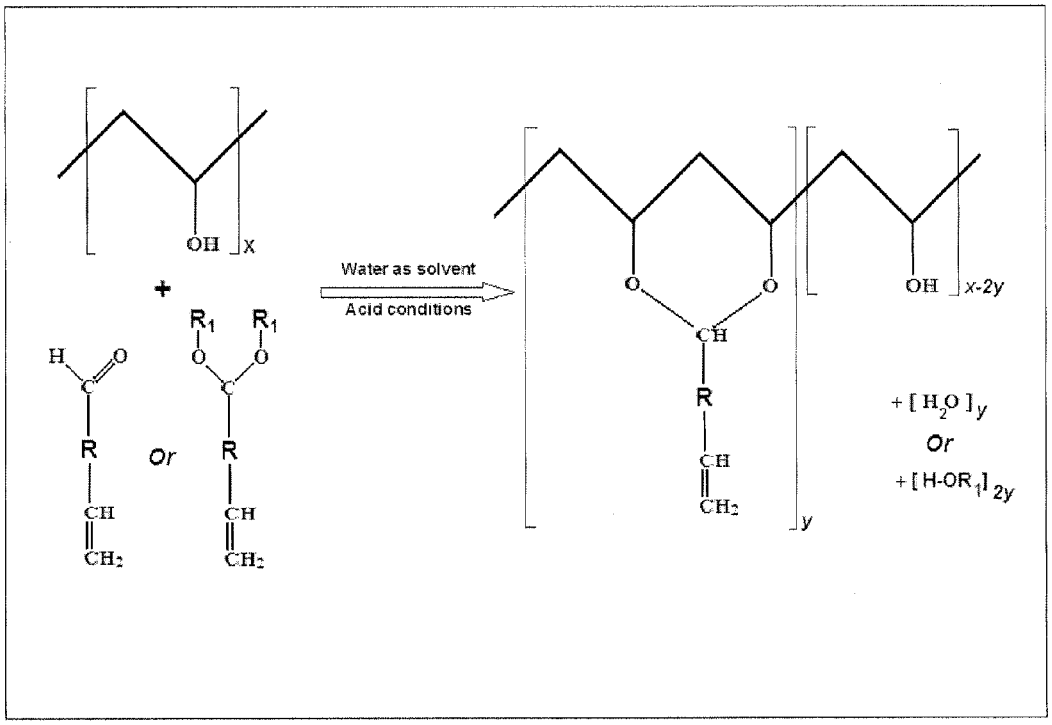
FIG. 1 represents the acetalization reaction in an aqueous and acidic medium between water soluble polymer containing hydroxyl functionalities, in this particular case PVA and the aldehyde having general formula.
Figure 2:
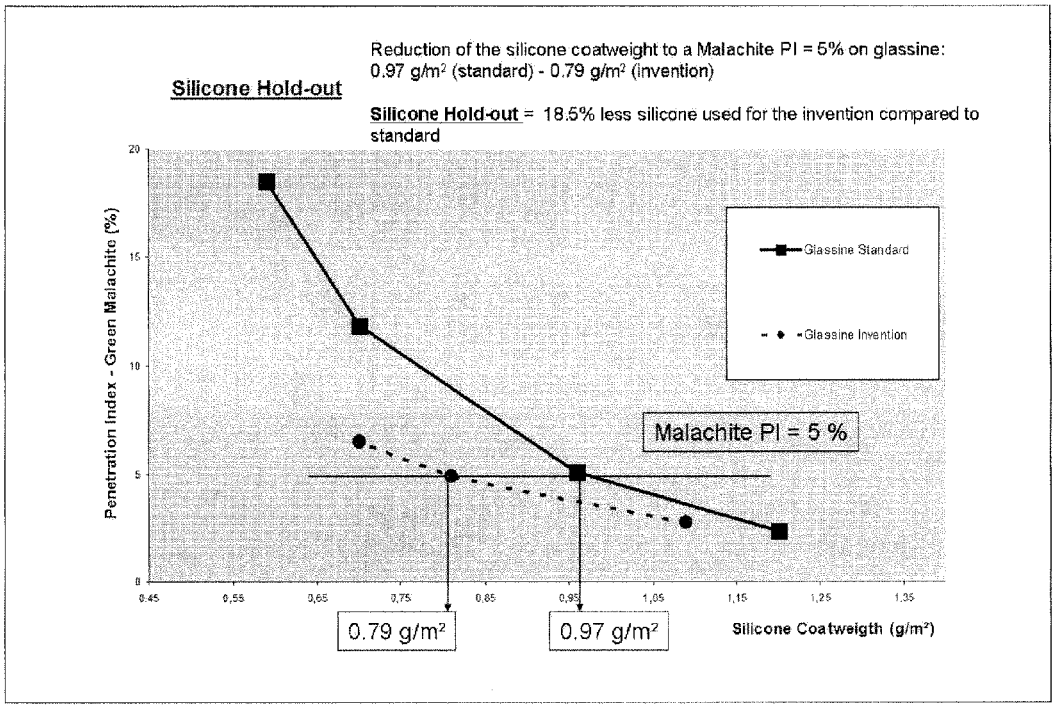
Figure 3:
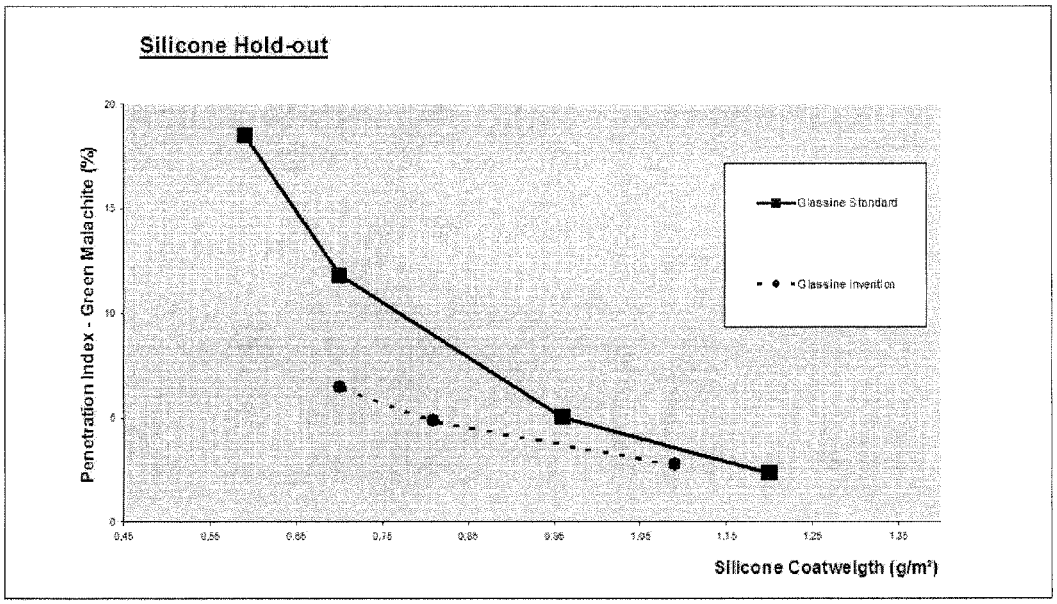

FIGS. 2 and 3 show the penetration indexes of the reagent Green Malachite plotted against the quantity of silicone deposited on the glassine. Two types of glassine are compared: standard glassine and the glassine obtained by the technology according to the invention. These tests are designed to evaluate the silicone hold-out, and are used to measure the degree to which the glassine can generate good silicone coverage.

Figure 4:
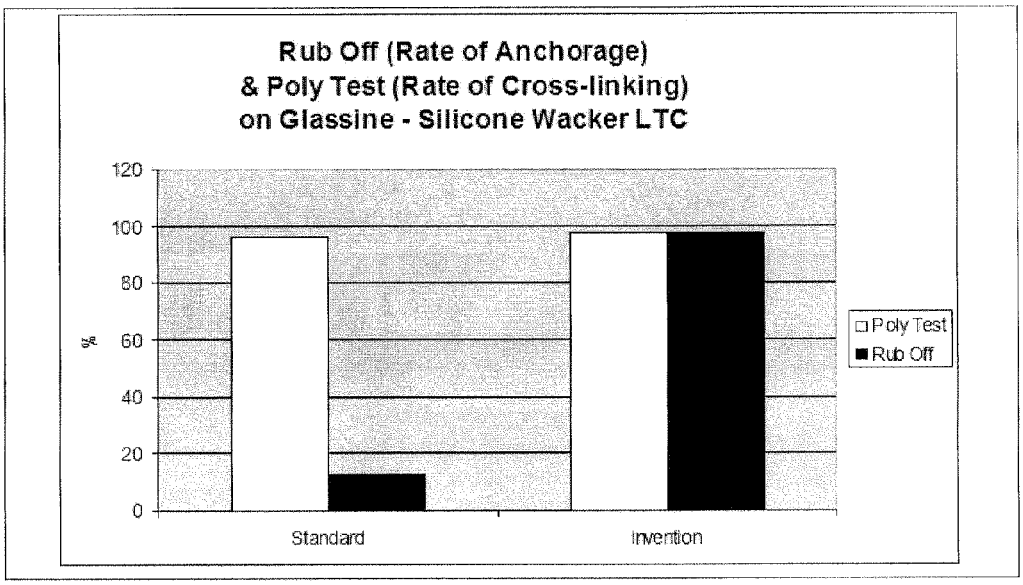

FIG. 4 illustrates the results of the Poly Tests (rate of cross-linking of the silicone) and "rub off" tests (to evaluate the silicone anchorage). Cross-linking of LTC silicones as well as the anchorage on the standard glassine and the glassine of the invention are compared.

Figure 5:
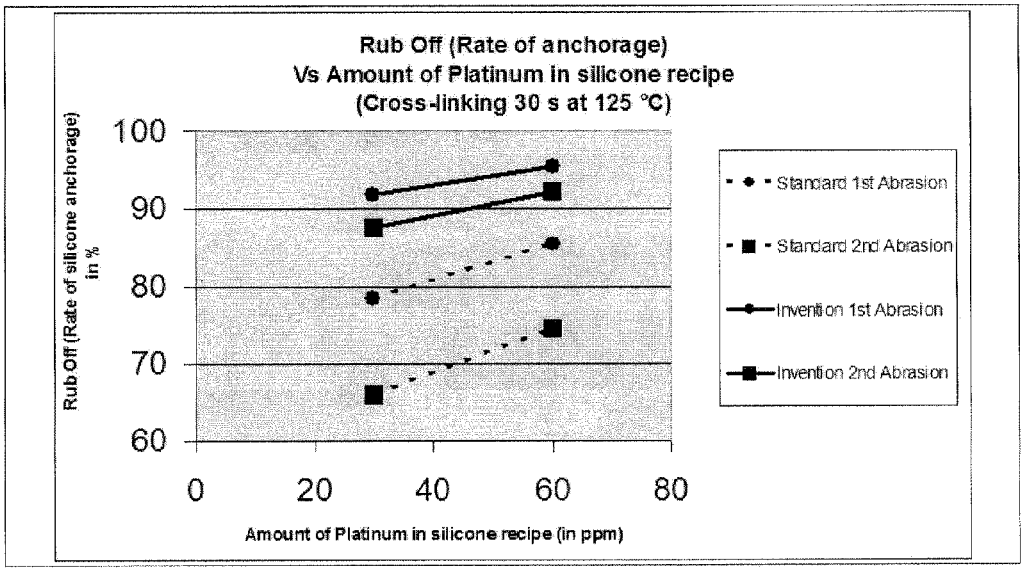

FIG. 5 shows the effect on silicone anchorage of a reduction in the quantity of catalyst (i.e.: Platinum) used. The siliconized standard glassine is compared to the siliconized glassine according to the invention. The results obtained in two series of rub off tests are thus expressed as a function of the quantity of Platinum used in the siliconizing step.

Figure 6:
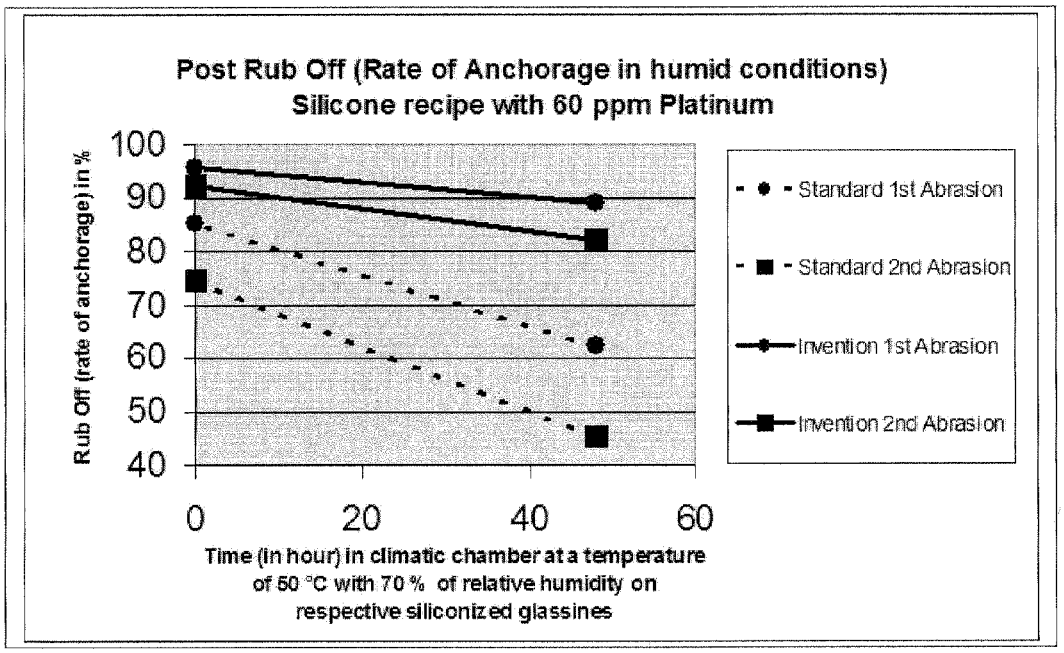
Figure 7:
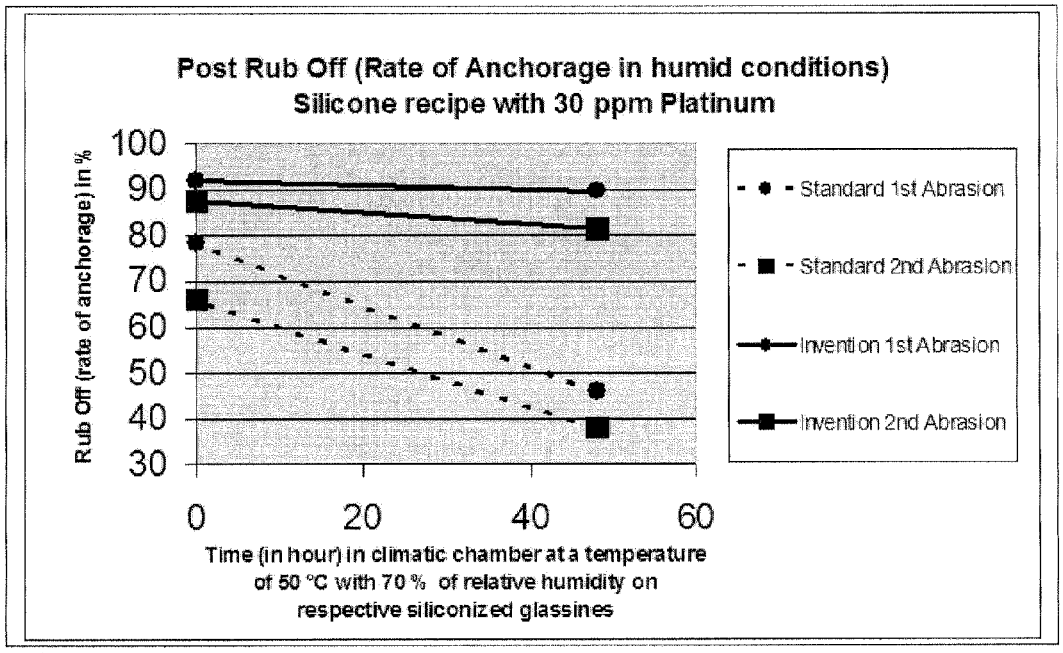

FIGS. 6 and 7 represent the results of "post rub off" tests, which were conducted on samples of siliconized standard glassine and siliconized glassine according to the invention. The rub off percentages are plotted against the exposure time for which the glassines were placed in a climate chamber at a temperature of 50° C. and 70% relative humidity, and according to the quantity of catalyst (i.e.: Platinum) used for siliconizing the glassine.

METHOD FOR PREPARING THE GLASSINE ACCORDING TO ONE EMBODIMENT OF THE INVENTION

A foil consisting of 100% cellulose fibres (58 g/m$^2$) is prepared by methods known to one skilled in the art, particularly including a step of refining of the fibres.

At the same time 344 kg PVA is reacted with 5 kg undecylenic aldehyde in 2500 L water with pH=1.5 and T=90° C. At the end of the reaction, typically after 20 to 25 minutes, the pH is adjusted to 7 by adding sodium hydroxide.

The mixture containing the functionalized PVA is then applied to a surface of the cellulose support by coating (1 g/m$^2$), preferably by metering-size-press, at 65° C.

The support is then dried, remoisturized, and super-calandered.

Unless otherwise stated, the following examples were conducted under the following conditions:

Supports Used:

Glassine according to the invention: as above.

Standard glassine: Silica Classic Yellow 59 g/m$^2$

Silicone

Blue Star Bath:

Polymer: 11367—50 g

Cross-linking agent: 12031—2.9 g

Catalyst (60 ppm of Platinum): 12070—1.56 g

Cross-linking for 30 seconds at 150° C. in ventilated drying kiln

Wacker LTC Bath:

Polymer: D920—18.07 g

Cross-linking agent: XV 525—1.43 g

Catalyst (i.e.: Platinum based): C05—2.14 g

Cross-linking for 30 seconds at 80° C. in ventilated drying kiln

For the sake of simplicity, in the following the glassine according to the invention will be referred to as "glassine INV".

Example 1

Reduction in Quantity of Silicone—Test of Effectiveness of Silicone Hold-Out (i.e.: Silicone Coverage)

In this example, which is illustrated by FIGS. 2 and 3, the penetration index by Green Malachite into the glassine is investigated according to the quantity of silicone deposited on the glassine.

The glassines used are standard glassine and glassine according to the invention, both having been produced on the same machine. The penetration indexes by Green Malachite plotted against the quantity of silicone deposited in the siliconizing step (i.e.: silicone coatweigth) are reproduced in table 1.

TABLE 1

| Silicone Coatweight (g/m$^2$) | Penetration Index (%) glassine INV | Penetration Index (%) standard glassine |
|---|---|---|
| 0.70 | 6.48 | 11.84 |
| 0.81 | 4.88 | |
| 0.96 | | 5.06 |
| 1.09 | 2.77 | |
| 1.20 | | 2.38 |

A high penetration index by Green Malachite indicates that the silicone layer is not good enough. Consequently, there will be inherent stability difficulties with the release forces of the self-adhesive complex.

The tests carried out showed that a penetration index by Green Malachite of less than 5% is obtained with the siliconized glassine INV for a layer of at least 0.79 g/m$^2$. In contrast, a layer of more than 0.97 g/m$^2$ is needed on standard glassine. This value is close to those of glassines that are in common industrial use, furnished with silicone layers in the range from 1 to 1.2 g/m$^2$.

The technology according to the invention thus enables a reduction of 18.5% in the quantity of silicone to be deposited compared with equivalent standard glassines without the loss of any silicone "barrier" properties. This technical improvement may make it possible not only to use less silicone but also the reduced the amount of catalyst (i.e.: Platinum) required, as is demonstrated in example 3.

Example 2

Anchorage of Low Temperature Curing (LTC) Silicones—"Rub Off" Test and Poly Test In this example, the rate of cross-linking (i.e.: Poly test) and the anchorage (i.e.: Rub test) of the silicone layer are examined. The LTC silicone was deposited at 80° C. on standard glassine and glassine according to the invention.

Two tests were carried out, and the results of both are summarised in FIG. 4. The first, the poly test, was designed to measure the quantity of silicone remaining on a sample of siliconized paper after it had been immersed in an organic solvent for uncross-linked silicone (toluene or MIBK). It is generally agreed that a rate higher than 95% is indicative of satisfactory cross-linking.

Results show that both glassines have poly test values higher than 95%, thus representing evidence of good silicone cross-linking on the support.

The second test, the rub off test, is an abrasion test designed to analyse the anchorage of the silicone to the paper. It measures the remaining silicone layer after an abrasion test on a textile under a weight. A rate above 90% is generally indicative of good anchorage. Value is significant if the poly test is higher than 95%.

The abrasion test demonstrates that LTC silicone has a very low anchorage on standard glassine satisfactorily at a siliconizing temperature of 80° C. Only 12.6% of the cross-linked silicone remained on the support. On the other hand, rate for the glassine INV was a satisfactory 97.7%, indicating that the anchorage of the silicone is correct thanks to the functionalized PVA.

The support according to the invention thus enables the siliconizing step to be carried out with satisfactory cross-linking using LTC silicones at a temperature significantly lower than that of standard glassines without causing losses in silicone anchorage.

Example 3

Silicone Anchorage Depending on the Quantity of Catalyst (i.e.: Platinum) Used

Another advantage associated with the present invention is that the quantity of catalyst (i.e.: Platinum) needed during the siliconizing step is reduced. The ability to obtain siliconized glassines using smaller amounts of catalyst (i.e.: Platinum) is highly attractive when one considers that nowadays Platinum accounts for about 30% of the total cost of the materials used in siliconizing.

FIG. 5 shows the results of rub off tests obtained for siliconized specimens of standard and INV glassines. These glassines have been siliconized in the presence of 30 or 60 ppm Platinum and placing in a kiln heated to 125° C. for 30 seconds.

With 60 ppm Platinum, the glassine INV shows a rate of rub off above 90% for the first and second abrasion tests. On the other hand, the rates obtained for standard glassine are slightly above 85% in the first test and below 75% in the second test. These results therefore show that the standard glassine prepared in these conditions does not satisfy the quality criteria, that is to say a rate higher than 90%.

The siliconized glassines prepared with 30 ppm Platinum have lower rub off rates than those of the preceding glassines. In this case, the rub off rates obtained for siliconized standard glassine are also lower than those for the glassine INV. The results in both tests are lower than 80%. A rate of 65.9% was even obtained in the second rub off test.

For the glassine INV that was siliconized in the presence of 30 ppm Platinum, the first test yields a value of almost 92%, whereas the second test returns 87.5%. These results are in fact higher than those obtained for the standard glassine prepared with 60 ppm of Platinum, that is to say twice the quantity of catalyst (i.e.: Platinum).

In general, reducing the quantity of catalyst (i.e.: Platinum) leads to difficulties getting a good silicone anchorage onto the glassine. These rub off problems have been eliminated with the aid of the INV technique. The figures are even higher for tests using 30 ppm Platinum on glassine INV than those for the same tests on standard glassine that is siliconized in the presence of 60 ppm Platinum. The anchorage properties of the glassine INV are significantly better than those of the standard glassines.

Example 4

Release Force Plotted Against the Quantity of Platinum Used

The release force was determined with respect to the quantity of Platinum used during siliconizing. It was surprising to note that both of the glassines in the comparisons (standard glassine and glassine INV) return identical values for all of the tests conducted, that is to say 88, 119 and 138 cN/5 cm for 83, 60 and 30 ppm Platinum respectively. The tests consisted in measuring the release forces for the glassines and for TESA 4970 adhesive one hour after pressing at 70° C.

Example 5

Post Rub off Phenomenon (50° C., 70% Humidity)

This example illustrates the service life of glassine INV compared with standard glassine under specific conditions. FIGS. 6 and 7 illustrate this example.

The post rub off phenomenon is associated with atmospheric temperature and humidity. Over time in hot, humid conditions, water molecules are able to penetrate the glassine/silicone interface. They then degrade the siliconized support and destroy the bonds that bind the silicone and the cellulose. Consequently, loss of silicone anchorage is observed and this is reflected in rub off rates that are lower than the initial results.

The tests are conducted in a climate chamber with temperature 50° C. and 70% relative humidity. The rub off tests were carried out at t=0 and after the glassines had been left in the climate chamber for 48 hours. Two abrasion tests were carried out in each case on the standard glassine and the glassine INV. The tests were repeated for the samples of both glassine types prepared in the presence of both 60 and 30 ppm Platinum.

For the sake of simplicity, the terms "glassine X-30" and "glassine X-60" (X=standard or INV) will be used in the following to denote the glassines that have been siliconized in the presence of 30 and 60 ppm Platinum respectively.

After exposure for 48, the glassine INV-60 returns a rate close to 90% for the first post rub off test. This represents a reduction of just over 5% relative to the initial test carried out at t=0. However, the rate is still significantly higher than the rate for standard glassine-60 (62%).

The second abrasion test returns a value higher than 80%, which is extraordinary compared with the standard glassine, for which the value was 45% under the same conditions.

Reducing the quantity of Platinum used in the siliconizing step from 60 to 30 ppm has no effect on the results obtained for the glassine INV. On the other hand, the abrasion problems observed with the standard glassine are aggravated.

In fact, after exposure for 48 hours, the first abrasion test for the glassine INV-30 returns a value of about 90%, while the second test is still above 80%. In contrast, the standard glassine-30 yields a value below 50% for the first abrasion test and about 38% for the second.

For all intents and purposes, the quality of silicone anchorage on the glassine INV-30 is the same as that observed for a glassine INV-60, particularly during the second rub off test. The results obtained for the glassine INV-30 are higher than those obtained for the glassine standard-60. The results of the post rub off test are comparable with those of the rub off test, thus indicating the wide range of possible applications for the supports according to the invention. The properties of the supports according to the invention therefore make them suitable for use in hot, humid countries such as Asian countries.

The results obtained for the glassine INV-30, that is to say the rub off rate >90%, are comparable with those obtained for the standard glassine that was siliconized using 83 ppm Platinum after 30 seconds of treatment in a kiln heated to 125° C.

Example 6

Increase of the Machine Speed and Decrease of Catalyst (i.e.: Platinum) in the Silicone Recipe in Siliconizing Process at Pilot Scale Standard Glassine and Glassine INV have been siliconized on a pilot machine. Pilot machine width is 1.3 meter and maximum machine speed is 1 610 m/min with an industrial kiln configuration.

Silicone used was:

Dow Corning SL 161 (similar to standard SL 160 silicone with the add of an anti-misting agent to allow the siliconizing process at high speed)

Standard Glassine and Glassine INV have been siliconized with standard silicone type: SL 161 at a silicone coatweight of 1 g/m$^2$. Speed of the machine was set between 900 m/min and 1200 m/min, the web temperature was set at 140° C. Poly test (cross-linking rate of silicone), Rub test (silicone anchorage) and Post rub off in humid conditions—50° C./70% HR for 48 hours (resistance of silicone anchorage to humid conditions) have been measured at different machine speed and different catalyst content (i.e.: Platinum) in the silicone recipe. Results are reported in table 2.

TABLE 2

| Web | Machine speed (m/min) | Catalyst (Platinum in ppm) | Web Temp. (° C.) | Poly Test (%) | Rub Test (%) | Post Rub Off (%) |
|---|---|---|---|---|---|---|
| Standard Glassine | 900 | 50 | 140 | 98 | 82 | 41 |
| Standard Glassine | 1000 | 50 | 140 | 98 | 62 | / |
| Glassine Inv | 1200 | 50 | 140 | 99 | 98 | 97 |
| Glassine Inv | 1200 | 40 | 140 | 98 | 94 | 92 |
| Glassine Inv | 1200 | 30 | 140 | 99 | 96 | 99 |
| Glassine Inv | 1200 | 20 | 140 | 98 | 92 | 93 |

On a first hand, standard Glassine did not show any problem of silicone cross-linking at a speed of 900 m/min and 1 000 m/min. Nevertheless, it showed some problems of silicone anchorage (i.e.: rub off value: 82%) even in standard conditions (machine speed: 900 m/min with Platinum content: 50 ppm). As soon as machine speed is increased (i.e.: 1000 m/min), silicone anchorage started to decrease to 62% rub off.

In the case of Glassine INV, we have been able to run at 1200 m/min without any problem of silicone cross-linking (poly test>95%) and silicone anchorage (rub test>90%). Catalyst content has also been reduced to a low value of 20 ppm Platinum without any problems.

Thanks to the invention, humid conditions is not destroying the silicone anchorage (i.e.: post rub off value>90%) while with Standard Glassine, humid conditions are destroying silicone anchorage (i.e.: rub test of 41%).

Example 7

Low Catalyst (i.e.: Platinum) Content in Silicone Recipe in Siliconizing Process at Pilot Scale Glassine INV has been siliconized on a pilot machine. Pilot machine width is 1.3 meter and maximum machine speed is 1 610 m/min with an industrial kiln configuration. In order to reduce as much as possible catalyst content a specific silicone system has been used (fast curing system silicone):

Dow Corning SL 400 (fast curing silicone system: 35 ppm Platinum instead of 50 ppm Platinum for SL 160)

Glassine INV has been siliconized with low catalyst silicone system type: SL 400 at a silicone coatweight of 1 g/m$^2$. Speed of the machine was 1200 m/min, the web temperature was set at 140° C. Poly test (cross-linking rate of silicone), Rub test (silicone anchorage) and Post rub off in humid conditions—50° C./70% HR for 48 hours (resistance of silicone anchorage in humid conditions) have been measured. Catalyst was set at 10 ppm of Platinum. Results are reported in table 3.

TABLE 3

| Web | Machine speed (m//min) | Catalyst (Platinum in ppm) | Web Temp. (° C.) | Poly Test (%) | Rub Test (%) | Post Rub Off (%) |
|---|---|---|---|---|---|---|
| Glassine Inv | 1200 | 10 | 140 | 95 | 85 | 79 |

In this trial, Silicone cross-linking (i.e.: poly test=95%) and silicone anchorage (i.e.: rub test is 85%, higher than standard Glassine siliconized at 50 ppm Platinum with SL 161 silicone at 900 m/min (Cf. example 6)) are at the positive limit meaning that it has been possible to run with the glassine from the invention at such low catalyst content: 10 ppm of Platinum. After 48 hours in humid conditions, silicone anchorage has not been altered as rub off value is at 79%.

Example 8

Use of such Functionalized PVA in Clay Coated Paper Recipes—Influence on Silicone Anchorage with LTC Silicone 80 g of PVA has been solubilised in 1 litter of water at 95° C. at laboratory scale. It has been then reacted with 1.3 g of undecenal in acid condition (pH=1.5 with sulphuric acid) at 90° C. for 1 hour. At the end of the reaction, pH has been adjusted to 7 by using sodium hydroxide, Such functionalized PVA has been then mixed with clay pigments with different amount of functionalized PVA:

16% of functionalized PVA and 84% of clay pigments (i.e.: low functionalized PVA recipe:LFP recipe)

28% of functionalized PVA and 72% of clay pigments (i.e.: high functionalized PVA recipe:HFP recipe)

Both recipes have been coated at a dry layer of 10 g/m$^2$ using a laboratory hand coater on A4 hand sheets made of industrial pre-coated paper of 135 g/m$^2$ from AHLSTROM commercial grade (i.e.: Silco). A4 hand sheets have been then calandered using a laboratory calander. Such laboratory papers made with LMP recipe and HMP recipe have been then siliconized with Wacker LTC silicone at laboratory scale at 80° C. at a silicone deposit of 1 g/m$^2$.

In order to compare the results, industrial clay coated paper from AHLSTROM, a Silco 135 g/m$^2$ (i.e.: standard clay coated paper: Stand CCP) has been siliconized in the same way with the two other papers from the invention (clay coated paper from the invention with LFP (i.e.: INV-CCP-LFP) and HFP (INV-CCP-HFP)).

Poly test (cross-linking of silicone) and rub test (silicone anchorage on paper) have been measured for the three grades and results are presented in table 4:

TABLE 4

| Paper web | Poly Test | Rub Test |
|---|---|---|
| Stand CCP | 97% | 47% |
| INV - CCP - LFP | 96% | 62% |
| INV - CCP - HFP | 96% | 93% |

In all cases, cross-linking of LTC silicone was good as all the poly tests were >95%. On the other and, differences in term of silicone anchorage could be seen from different papers as rub test is very low for the standard clay coated paper (i.e.: 47%). Anchorage of LTC silicone is improved thanks to the invention as the rub test increase with the amount of functionalized PVA in the clay coated recipe from 62% for INV-CCP-LFP to 93% for INV-CCP-HFP.

Standard clay coated paper are produced with binder such as latex (i.e.: such as Polyvinyl acetate, Polyacrylate, Poly (styrene-butadiene), etc. . . . ) and water soluble polymer (i.e.: such as starch, PVA, etc. . . . ). Anchorage of LTC silicone of such grade is very low (i.e.: 47%). By replacing standard binder by the functionalized PVA from the invention, anchorage of LTC silicone on clay coated paper can be improved (i.e.: rub test of 93%).

It has been showed in the past on glassine from the invention, that by improving silicone adhesion with LTC silicone, other advantages can be improved with standard silicone such as:

Increase siliconizing speed on converting machine

Decrease catalyst content in silicone recipe (i.e.: Platinum)

Improve silicone anchorage in humid conditions

Decrease silicone consumption

Such parameters then might be improved on a clay coated paper produced with the functionalized PVA of the invention thanks to the preliminary results obtained by using LTC silicone.

The technology according to the invention thus enables the quantities of catalyst (i.e.: Platinum) used for siliconizing to be reduced by more than 60% relative to the standard glassines. In experiments conducted under the same conditions, it was observed that anchorage of silicone on the functionalized PVA is superior to that obtained for all standard glassines that had been siliconized in conventional processes with a Platinum catalyst, whether the silicones used were standard or LTC silicones. This considerable improvement is due to the formation of covalent bonds between the glassine and the silicone.

To summarise, the cellulose fibre-based support according to the invention enables formation of an improved silicone hold-out and better anchorage of the silicone even after prolonged exposure to hot, humid conditions. The invention further makes it possible to reduce the quantities of silicone and the Platinum catalyst used in siliconization.

The invention claimed is:

1. A cellulose fibre-based support having at least one surface coated with a layer comprising at least one water-soluble polymer having hydroxyl functions, wherein at least some of the hydroxyl functions have been reacted before coating onto the cellulose fibre-based support with at least one organic molecule that contains an aldehyde function and at least one vinylic function.

2. The cellulose fibre-based support according to the claim 1, wherein the aldehyde function of said organic molecule is in the form of a hemiacetal or acetal.

3. The cellulose fibre-based support according to claim 1, wherein the water-soluble polymer having hydroxyl functions is selected from the group consisting of polyvinyl alcohol (PVA), starch, alginate, carboxymethyl cellulose (CMC), and at least partially hydrolysed copolymers of vinyl acetate.

4. The cellulose fibre-based support according to claim 1, wherein the water-soluble polymer having hydroxyl functions is polyvinyl alcohol (PVA).

5. The cellulose fibre-based support according to claim 1, wherein the organic molecule has the $CH_2{=}CH{-}(R){-}CH{=}O$ or $CH_2{=}CH{-}(R){-}CH(OR_1)_2$, where R is a linear, branched and/or cyclic carbon chain that may contain heteroatoms, and $R_1$ independently is a hydrogen atom or an optionally branched, saturated or unsaturated, optionally substituted alkyl radical having from 1 to 12 carbon atoms optionally interrupted by N, O, or S heteroatoms.

6. The cellulose fibre-based support according to claim 1, wherein said organic molecule is undecylenic aldehyde.

7. The cellulose fibre-based support according to claim 1, wherein said organic molecule represents between 0.1 and 5% by weight of the water-soluble polymer having hydroxyl functions.

8. The cellulose fibre-based support according to claim 1, wherein the functionalized water-soluble polymer having hydroxyl functions constitutes at least 10% by weight of a top layer applied on the cellulose fibre-based support.

9. The cellulose fibre-based support according to claim 8, wherein the top layer applied on the cellulose fibre-based support is deposited in a quantity of 0.2 to 20 $g/m^2$.

10. The cellulose fibre-based support according to claim 1, wherein the fibre-based support has a mass of cellulose fibres which is in a range from 30 to 160 $g/m^2$.

11. A method for producing a cellulose fibre-based support as recited in claim 1, comprising the following steps:

(a) forming the cellulose fibre-based support;

(b) functionalizing the water-soluble polymer having hydroxyl functions by grafting at least one organic molecule having at least one vinylic function and one aldehyde function that are capable of forming covalent bonds with the hydroxyl functionalities of the water-soluble polymer having hydroxyl functions;

(c) coating the cellulose fibre-based support with at least the functionalized water-soluble polymer having hydroxyl functions obtained according to step (b); and optionally (d) calendering or supercalendering the coated cellulose fibre-based support.

12. The method according to the claim 11, wherein formation of the cellulose fibre-based support is practiced with or without a parchementizing step.

13. The method according to claim 11, wherein step (b) is practiced by functionalizing the water-soluble polymer having hydroxyl functions at a temperature between 20 and 95° C. in an aqueous medium and in the presence of an organic or inorganic acid to achieve acid condition.

14. The method according to claim 10, wherein step (c) is practiced by coating the fibre-based support by a coating technique selected from the group consisting of size-press, foulard coating, rod coating, air-knife coating, gravure coating, scraper blade coating, sliding blade coating, single- and multilayer curtain coating, reverse roll coating, spray coating, atomisation coating, liquid application system (LAS) coating, kiss coating, and foam coating.

15. The method according to claim 11, wherein step (c) is performed at a temperature between 20 and 80° C.

* * * * *